US009598775B2

(12) United States Patent
Belov

(10) Patent No.: US 9,598,775 B2
(45) Date of Patent: Mar. 21, 2017

(54) MULTILAYER OVERLAY SYSTEM FOR THERMAL AND CORROSION PROTECTION OF SUPERALLOY SUBSTRATES

(75) Inventor: Irina Belov, Zionsville, IN (US)

(73) Assignee: PRAXAIR S.T. TECHNOLOGY, INC., North Haven, CT (US)

( * ) Notice: Subject to any disclaimer, the term of this patent is extended or adjusted under 35 U.S.C. 154(b) by 0 days.

(21) Appl. No.: 13/493,593

(22) Filed: Jun. 11, 2012

(65) Prior Publication Data

US 2013/0004712 A1 Jan. 3, 2013

Related U.S. Application Data

(60) Provisional application No. 61/496,270, filed on Jun. 13, 2011, provisional application No. 61/504,865, filed on Jul. 6, 2011.

(51) Int. Cl.

| | |
|---|---|
| ***B32B 15/02*** | (2006.01) |
| ***B05D 7/14*** | (2006.01) |
| ***B05D 1/38*** | (2006.01) |
| ***B32B 3/30*** | (2006.01) |
| ***B32B 15/04*** | (2006.01) |
| ***C23C 24/08*** | (2006.01) |
| ***F01D 5/28*** | (2006.01) |

(52) U.S. Cl.

CPC ..... *C23C 24/08* (2013.01); *F01D 5/288* (2013.01); *Y10T 428/24413* (2015.01); *Y10T 428/24975* (2015.01)

(58) Field of Classification Search

None

See application file for complete search history.

(56) References Cited

U.S. PATENT DOCUMENTS

| | | | | |
|---|---|---|---|---|
| 5,985,454 | A | 11/1999 | McMordie et al. | |
| 7,314,674 | B2 | 1/2008 | Hazel et al. | |
| 7,462,654 | B2 * | 12/2008 | Field | 523/200 |
| 7,754,342 | B2 | 7/2010 | Hazel et al. | |
| 2006/0180788 | A1 * | 8/2006 | Scott et al. | 252/79.1 |
| 2008/0250769 | A1 * | 10/2008 | Wagner et al. | 60/39.24 |
| 2009/0176110 | A1 * | 7/2009 | Pabla et al. | 428/450 |
| 2010/0006001 | A1 * | 1/2010 | Hazel et al. | 106/14.05 |
| 2011/0008614 | A1 | 1/2011 | Muth et al. | |

FOREIGN PATENT DOCUMENTS

| | | | |
|---|---|---|---|
| EP | 0142418 | A1 | 5/1985 |
| EP | 0150650 | A2 | 8/1985 |
| EP | 0739953 | A2 | 10/1996 |

OTHER PUBLICATIONS

"Guideline for Coating of the Compressor Section of Combustion Turbines in Power Generation Applications" EPRI Technical Update Report, Palo Alto, CA: 2006. 1010394.

Praxair Surface Technologies "SermaFlow™ Coatings". Praxair S. T. Technologies. 2010 P10285.

Taneichi, Kaori et al. "Oxidation or Nitridation Behavior of Pure Chromium and Chromium Alloys Containing 10 mass % Ni or Fe in Atmospheric Heating". Materials Transactions, vol. 47, No. 10 (2006) pp. 2540 to 2546.

* cited by examiner

*Primary Examiner* — Ronak Patel

(74) *Attorney, Agent, or Firm* — Nilay S. Dalal

(57) ABSTRACT

A high surface finish, thermally stable, multilayer slurry-based overlay system suitable for use in a severe thermal environment is disclosed. The disclosed embodiments include a basecoat layer formed from a slurry comprising ceramic pigment filled phosphate-based binder, a second layer formed from a slurry comprising metal oxide pigment or ceramic oxide pigment filled phosphate-based binder, and an optional seal coat layer formed from a phosphate-based binder substantially free of pigments.

25 Claims, 5 Drawing Sheets

*Multilayer Overlay System of prior art on Inconel 718 Substrate: Thermal Stability test at 1400F/145 hrs*

Spallation observed

*Typical defects of the prior art overlay system (Optical microscope 20X):*

*On steel panel* *on Udimet 720 blade*

*Coating system on 1010 steel panels: Optical microscopy (20X)*

*Group A* *Group B*

*Coating system on Group A panel: SEM and EDS analysis*

*50X* *1000X*

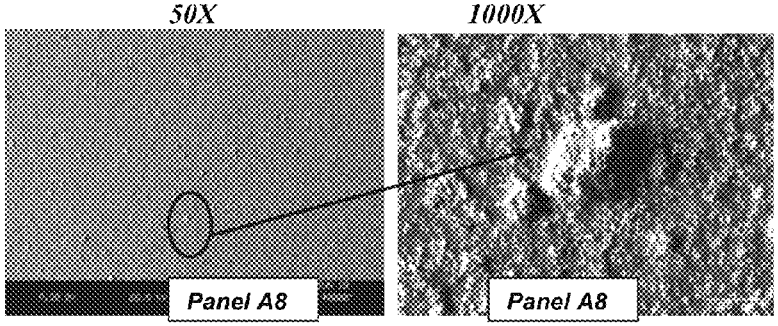

Particle composition, wt.%

| | |
|---|---|
| *O* | *35.8* |
| *P* | *5.4* |
| *Cr* | *54.8* |

FIG. 4A FIG. 4B

*Multilayer overlay system of the prior art on steel panel: Optical, SEM and EDS analysis*

Optical 20X SEM 1000X

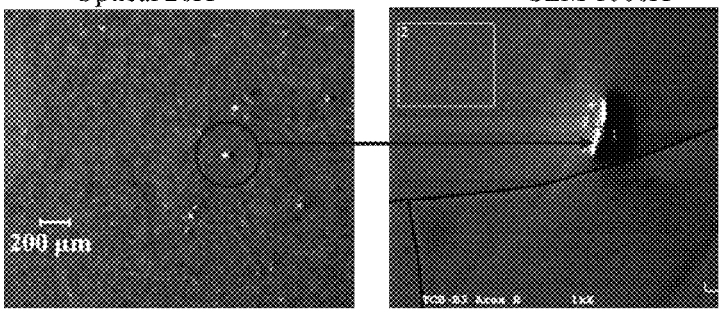

EDS

| Location | 1 particle | 2 matrix |
|---|---|---|
| O, wt% | 35.8 | 53.2 |
| Mg, wt% | 2.7 | 10.9 |
| P, wt.% | 5.4 | 28.0 |
| Cr, wt.% | 54.8 | 6.7 |

*Data show that gritty inclusions in the overlay are oversized particles of Cr2O3*

FIG. 5A FIG. 5B

*Multilayer Overlay System on Udimet 720 Blades: present invention (sample 21A) vs. prior art (sample 191)*

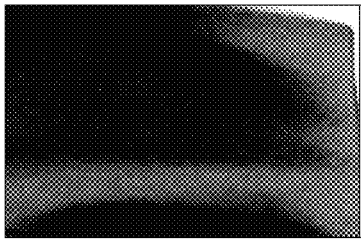

Sample 21A:
*Typical Ra = 10 ...15 µin*
*Typical Gloss = 75 ...80%*

FIG. 6A

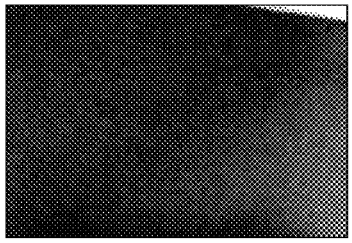

Sample 191:
*Typical Ra = 19 -22 µin*
*Typical Gloss = 40 ... 50%*

FIG. 6B

*Diagram of a coated superalloy part showing thickness measurement locations*

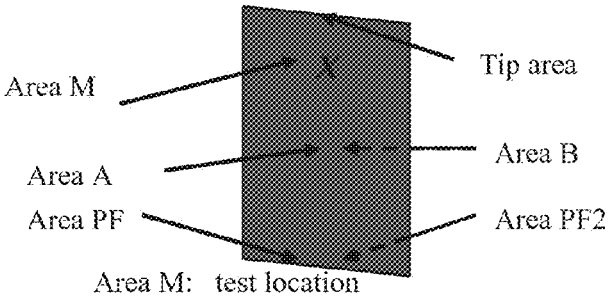

Area M: test location
Tip Area: Tip of the part
Area A: middle of the part on one side of the part
Area B: opposite to Area M, other side of the part
Area PF: pedestal of the part
Area PF2: pedestal on the other side of the part

FIG. 7

*SEM micrographs of the coated Part 21 -197 with measured thickness*

*Area M* *2000X* *Area A*

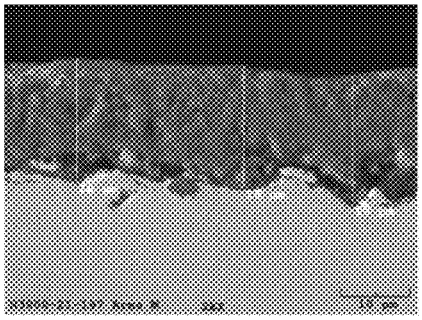

FIG. 8A

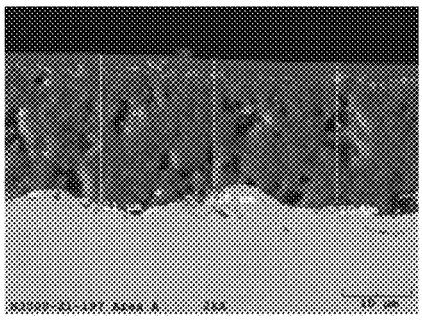

FIG. 8B

*Coating system thickness in different areas on the parts*

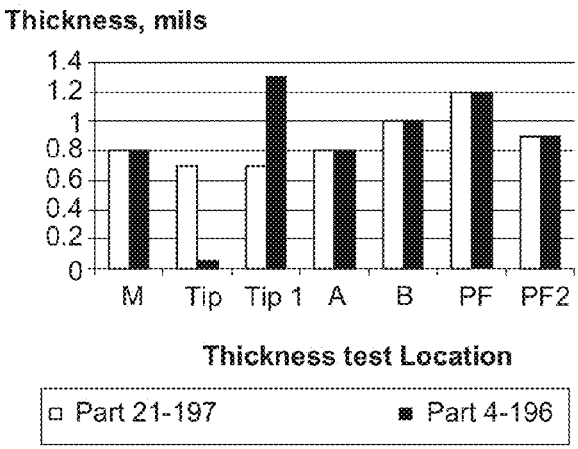

FIG. 9

*SEM micrographs of the Tip Area on Part 21-197 and Part 4-196 (1000X)*

Part 21-197(present invention Slurry B): Tip area has a very uniform coating

Part 4-196 (prior art SlurryA): Tip area has a bare spot next to the spot with thick coat

*Multilayer Overlay System of the present invention on Inconel 718 Substrate: Thermal Stability test at 1400F/145 hrs*

No spallation of the overlay

*Multilayer Overlay System with different intermediate layer slurries on Udimet 720 pins: Before and after Hot Corrosion test*

*As-coated pins:*
*J, P, I, M – overlay of the present invention*
*G, H , K, O – prior art overlay system*
*L – bare pin*

*Pins after test*

MULTILAYER OVERLAY SYSTEM FOR THERMAL AND CORROSION PROTECTION OF SUPERALLOY SUBSTRATES

CROSS REFERENCE TO RELATED APPLICATIONS

This application claims priority to U.S. provisional application Ser. No. 61/496,270 filed Jun. 13, 2011 and 61/504,865 filed Jul. 6, 2011, the disclosures of which are incorporated by reference herein.

FIELD OF THE INVENTION

The present invention relates to a thermally stable and corrosion protective multilayer overlay system suitable for use on turbine engine components, and more particularly, to a smooth thermally stable and corrosion protective multilayer overlay system and method for producing the said overlay system that includes a basecoat layer formed by applying a slurry comprising metal oxide particles dispersed in a phosphate-based binder, a second layer formed by applying a slurry comprising metal oxide pigment particles dispersed in a phosphate-based binder, and an optional seal coat layer formed by applying a slurry comprising a phosphate-based binder that is substantially free of pigments.

BACKGROUND

The surfaces of turbine engine parts are exposed to the hot gases from the turbine combustion process. Turbine engine superalloy materials are selected based on their high temperature stability and corrosion resistance. Well-known superalloys, for example nickel based superalloys such as Inconel™ 718, Inconel™ 722 and Udimet™ 720 demonstrate good resistance to oxidation and corrosion damage. However even these materials experience degradation under severe conditions at high temperatures. Oxidation and corrosion reactions at the surface of the component parts can cause metal wastage and loss of wall thickness. The loss of metal rapidly increases the stresses on the respective component part and can ultimately result in part failure. Protective overlays are thus applied to these component parts to protect them from degradation by oxidation and corrosion.

Various corrosion-resistant layers and multilayer overlay systems have been suggested and used to protect turbine engine components, particularly compressor rotor blades. Assessment of the prior art overlay systems have revealed general deficiencies in their functional properties and appearance, as well as several possible failure modes.

For example, a prior art commercially available multilayer overlay system is designed for lower service temperatures and provides effective protection up to 1200° F. However this prior art overlay system would be prone to cracking and delamination at elevated operating temperatures (≥~1300° F.) of newer engines if it were used on such advanced engines. FIG. 1 shows delamination of the prior art overlay system from Inconel™ 718 substrate exposed to 1400° F. for 145 hrs, which is at a temperature significantly above its designed operating temperatures.

FIGS. 2A and 2B illustrate[s] other issues or problems associated with prior art multilayer overlay systems. The prior art coated substrates in FIGS. 2A and 2B show a "gritty" coating appearance (i.e. visible particle inclusions). These particle inclusions were observed after application of intermediate layers and tend to become more pronounced after application of the seal coat layer. These defects were attributed to external contamination during layer application, such as airborne contaminants, surface irregularities, etc.

Other type of possible issues or problems that may be associated with the prior art based overlay systems are the 1 mm to 3 mm diameter round spots (i.e. "white spots") on some parts coated with the prior art overlay system. As seen in FIGS. 2A and 2B, the "white spots" appear much lighter in color than the remainder of the coated blade and contain an excess or "bubbled" material inside the round spot. These "white spots" appear to form upon application of the seal coat. Coated blades using the prior art multilayer overlay system may also exhibit a "picture frame" effect with the layers being thicker near the blade edges, thus leading to weaker overlay adhesion and likely edge peeling. All these defects being irregularities in the sealed overlay surface not only reduce aerodynamic efficiency of the blade, but also might serve as active sites for thermal and corrosion attack.

In view of the above-identified concerns and disadvantages, a need exists for continuous improvements to the surface finish characteristics as well as thermal and corrosive performance of the prior art slurry-based, multilayer overlay systems. While the prior art slurry-based, multilayer overlay systems meet the requirements and specifications of current engine manufacturers, improvements are needed for use with newer, more advanced engines. It would therefore be desirable to provide a multilayer overlay system that improves upon the surface finish characteristics of the prior art overlay systems and possesses improved thermal stability in normal and corrosive environments.

SUMMARY OF THE INVENTION

In one aspect the invention may be characterized as an overlay system comprising: (i) a basecoat layer formed by applying a slurry comprising metal or metal oxide pigment particles dispersed in a phosphate-based binder, the basecoat layer having a thickness of between about 0.5 to 3.0 mils; and (ii) a second layer formed by applying a slurry comprising metal oxide pigment particles, preferably chromium oxide pigment particles, dispersed in a phosphate-based binder, wherein the metal oxide pigment particles have enhanced dispersibility due to a narrow particle size distribution and optimized surface area, the second layer having a thickness of between about 0.1 to 1.0 mil; The multilayer overlay system of the present invention demonstrates improved thermal and corrosion stability and surface finish characteristics compared to prior art slurry based multilayer overlay systems.

In yet another aspect the invention may be characterized as an overlay system comprising: (i) a basecoat layer formed by applying a slurry comprising aluminum oxide pigment particles dispersed in a phosphate-based binder, the basecoat layer having a thickness of between about 0.5 to 3.0 mils; (ii) a second layer formed by applying a slurry comprising chromium oxide pigment particles dispersed in a phosphate-based binder, wherein the chromium oxide pigment particles have a narrow particle size distribution with median particle size (characterized as the $50^{th}$ percentile of the particle size distribution) of between about 0.8 to 2.2 microns and surface area of the particles is greater than or equal to about 4 m 2/g, the second layer having a thickness of between about 0.1 to 1.0 mil; and wherein the surface roughness of the basecoat layer and the second layer in the overlay system is less than or equal to about 30 μin. The multilayer overlay system of the present invention demonstrates improved thermal stability in corrosive and noncorrosive environment, and surface finish characteristics compared to prior art slurry based multilayer overlay systems.

In yet another aspect, the invention may be characterized as a method or process for coating a metal substrate comprising the steps of: (i) preparing surface of the metal substrate; (ii) applying a slurry based ceramic pigment filled phosphate-based binder to the metal substrate to form a basecoat layer, the basecoat layer having a thickness of between about 0.5 to 3.0 mils; (iii) curing the coated substrate with the basecoat layer; (iv) preparing a slurry comprising chromium oxide pigment particles dispersed in a phosphate-based binder, wherein the chromium oxide pigment particles have a narrow particle size distribution with median particle size (characterized as the $50^{th}$ percentile of the particle size distribution) of between about 0.8 to 2.2 microns, and surface area of the particles is greater than or equal to about 4 m 2/g, (v) applying said slurry to the basecoat layer to form a second layer, the second layer having a thickness of between about 0.1 to 1.0 mil; and (vi) curing the coated substrate with the basecoat layer and the second layer. The multilayer overlay system of the present invention demonstrates improved surface finish characteristics and thermal performance compared to prior art slurry based multilayer overlay systems.

In yet a further aspect, the invention may be characterized as a product by process wherein the product is a coating applied by the process comprising the steps of: (i) applying a slurry based alumina oxide pigment filled phosphate-based binder to the metal substrate to form a basecoat layer, the basecoat layer having a thickness of between about 0.5 to 3.0 mils; (ii) preparing a slurry based chromium oxide pigment filled phosphate-based binder wherein the chromium oxide pigment particles have a particle size distribution characterized in that the $50^{th}$ percentile of the particle size distribution is a diameter of between about 1.0 to 2.0 microns and the $90^{th}$ percentile of the particle size distribution does not exceed a diameter of about 3.0 microns; and (iii) applying the stable slurry based chromium oxide pigment filled chromate-phosphate binder to the basecoat layer to form a second layer having a thickness of between about 0.1 to 1.0 mil The multilayer overlay system of the present invention demonstrates improved surface finish characteristics and thermal performance compared to prior art slurry based multilayer overlay systems.

BRIEF DESCRIPTION OF THE DRAWINGS

The above and other aspects, features, and advantages of the present invention will be more apparent from the following, more detailed description thereof, presented in conjunction with the following drawings, wherein:

FIGS. 4A and 4B show[s] SEM images at 50× and 1000× magnification and EDS analysis data of the prior art two-layer overlay system having oversized particles of chromium oxide pigment "protruding" from the phosphate-based matrix formed by the binder;

FIGS. 5A and 5B show[s] optical (20×) and SEM images (1000×) and EDS analysis data of the prior art three-layer overlay system having "gritty" inclusions of oversized particles of Cr2O3;

FIGS. 6A and 6B show[s] images of Udimet 720 blade coated with three-layer overlay system of the present invention (Sample 21A) having an improved surface finish compared to Udimet 720 blade coated with overlay system of the prior art (Sample 191).

FIG. 7 shows coating thickness measurements locations on a complex-shaped superalloy part;

FIGS. 8A and 8B show[s] an example of SEM micrographs with the coating system thickness measurements of a part coated using Slurry B of the present invention;

FIG. 9 shows a graph of coating thickness in different measurement locations

DETAILED DESCRIPTION

Figure 1:
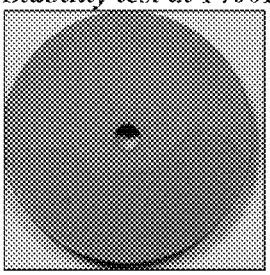
FIG. 1 shows Inconel 718 disc coated with the prior art multilayer overlay system, in which spallation of the coating was observed after exposure to 1400° F. for 145 hours.
Figures 2A, 2B:
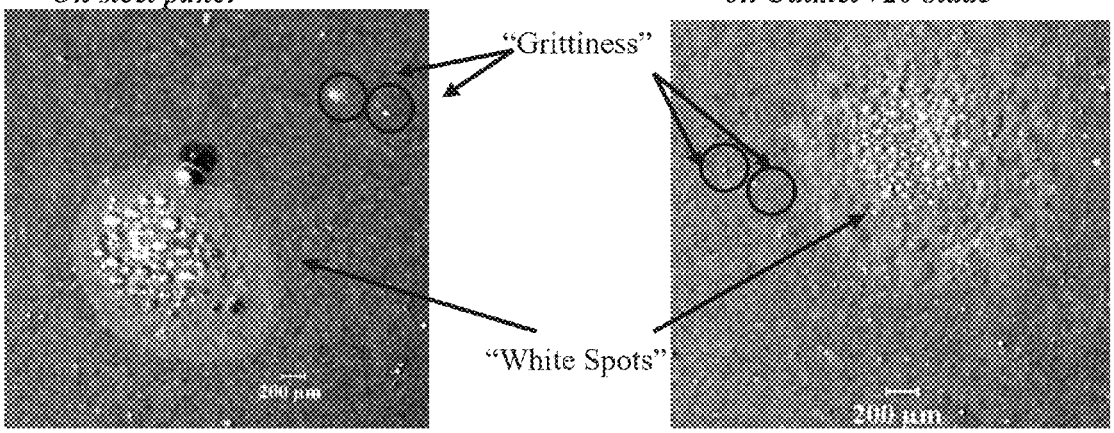
FIGS. 2A and 2B show[s] optical microscope images at 20× magnification of the prior art multilayer overlay system applied to various substrates and exhibiting various defects.
Figures 3A, 3B:
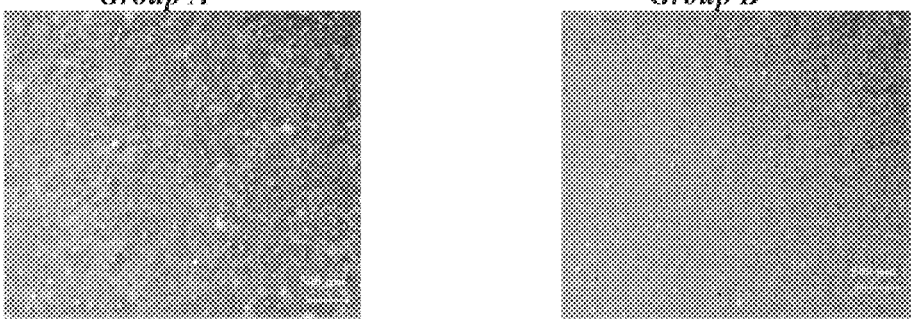
FIGS. 3A and 3B show[s] optical microscope images at 20× magnification of panels that were coated with two-layer overlay system; coating system of the present invention, wherein Slurry B was employed to produce the second layer, to be consistently smoother and glossier than the panels produced with Slurry A of the prior art.
Figure 10A:
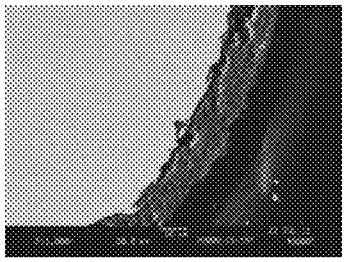
FIGS. 10A, 10B and 10C show[s] SEM micrographs of a Tip area of a part coated using Slurry B and another part coated using Slurry A of the prior art.
Figure 10B:
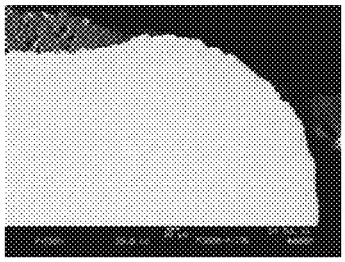
Figure 10C:
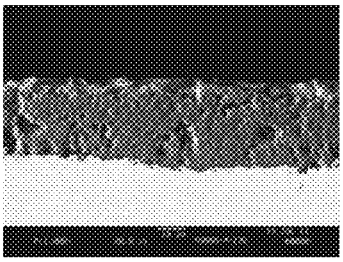

It is well known in the art that absolute numbers measured for particle size and particle size distribution for particulate systems, such as pigment powders and pigment containing slurries, are strongly dependent on testing and/or measurement technique and instrumentation. Thus it is very important to emphasize that particle size D50 and D90 numbers of the present invention have been obtained via laser diffraction technique by employing MicroTrac SRA Particle Analyzer as a particle measuring equipment. As used herein, "D50" refers to a median particle size in which 50 percent of particles are smaller and the other 50 percent of the particles are larger than the median size, and "D90" refers to a particle size in which ninety percent of particles are smaller than the particle size.

It is also known in the art that absolute numbers for Surface Area (SA) of pigment powders also depends on measurement technique and instrumentation. Thus it is very important to emphasize that SA numbers of the present invention were obtained by nitrogen gas absorption technique by BET method employing Gemini 2360 V4.01 measuring system.

Slurries were also characterized by their pH, viscosity, specific gravity and solids content. These parameters, together with D50 and D90, were monitored to test stability and aging of the slurries Other test methods and equipment were used in the present invention. Thickness of the coating layers was measured by FisherScope MMS (Eddy current and magnetic induction probes, depending on the type of the substrate). The surface finish (smoothness Ra) was measured by Mitutoyo Surftest 301 at a 5.1 mm traverse and 0.030" (0.76 mm) cutoff. The coatings gloss was tested by BYK Gardner Micro-gloss 60°. Coatings adhesion to a substrate and inter-layer adhesion were tested by cross-hatch tape (per ASTM Standard D3359) and bend (90° bend around a 6.4 mm diameter mandrel) tests. Optical microscopy and SEM/

EDS analysis were employed for detailed investigation of the coatings surface and cross-section morphology, microstructure and elemental composition.

One embodiment of the invention is a multi-layered overlay system suitable for use in harsh environments such as environments associated with turbomachinery. The first layer of the multi-layered overlay system, which is in contact with the metal substrate or metal surface of the turbomachinery, is a metal or/and metal oxide pigment filled inorganic binder, preferably a ceramic pigment filled inorganic binder, having a thickness of between about 0.5 to 3.0 mils. More preferably, the first layer or basecoat is aluminum oxide (e.g. alumina) pigment filled phosphate-based binder. Alternatively, the first layer may contain other non-metallic pigments like zirconia, ceria, other mixed metal oxides and/or combinations thereof in lieu of or in addition to the alumina oxide.

The first layer or basecoat may also optionally contain additional additives such as surfactants, wetting agents and other conventional additives. In addition to the ceramic pigment, other particulate metals, such as aluminum, copper, silver, or nickel may be included in the first layer.

The inorganic binder solution associated with the first layer is preferably an acidic phosphate solution, more preferably includes chromate compounds, or the metal salts thereof dissolved in an acidic phosphate compound. These binder solutions are particularly useful because of their ability to polymerize under drying and curing cycle and to form a continuous glassy matrix with good mechanical strength, flexibility, as well as some corrosion and thermal resistance.

The first layer is applied to a thickness of between 0.5 to 3.0 mils with preferable thickness of this first layer being 0.8 to 1.3 mils. The minimum thickness is determined by a very strong correlation between surface roughness (Ra) and thickness of the basecoat layer: sharp decrease in Ra of this basecoat layer, as well as in Ra of the whole multilayer overlay system has been observed when thickness of 0.8 mils of the first layer has been achieved. The maximum thickness of the basecoat layer is generally determined by a targeted or specified thickness of the entire multilayer overlay system. It is customary and desirable not to apply a layer in excess of functional requirement for the overlay system.

Controlling the surface roughness of basecoat layer is important, as it influences the surface roughness of both the second layer and optional seal coat layer. Preferably, the surface roughness (Ra) of the basecoat layer should be 30 μin or less, and more preferably 20 μin or less. If the surface roughness in the basecoat layer is too high (e.g. >30 μin), then higher surface roughness values will likely occur in the second layer and optional seal coat layer. In other words, surface roughness corrections (i.e. downward adjustments) during application of the second layer and an optional seal coat layer are not feasible or capable if the surface roughness of the basecoat layer is too high.

The second layer of the multi-layered overlay system comprises fine metal oxide pigments of prescribed particle size, particle size distribution (PSD) and Surface Area (SA). Preferably, the second layer is a chromium oxide (e.g. $Cr_2O_3$) pigment filled phosphate-based binder. Any phosphate-based binder as known in the art may be used. Preferably, the phosphate-based binder is chromate-phosphate. The chromate-phosphate binder of the second layer generally comprises chromate compounds, or the metal salts thereof dissolved in an acidic phosphate compound. The second layer is applied to the first layer to a thickness of between about 0.1 to 1.0 mils.

In the preferred embodiment, the chromium oxide pigment particles have a narrow PSD with median particle size D50 (characterized as the $50^{th}$ percentile of the PSD) of between about 0.8 to 2.2 microns and oversized particle size D90 (characterized as the $90^{th}$ percentile of the PSD) not exceeding about 3.0 microns. The preferred SA of the particles is at least 4 $m^2/g$ to 5 $m^2/g$ and more preferably about 6 $m^2/g$. Properties of chromium oxide pigment particles of the preferred embodiment (denoted as Powder II) are shown in Table 1. By way of comparison, the prior art multilayer overlay system has the second layer comprising chromium oxide pigment particles with median particle size D50 of 2.5 microns, oversize particle size D90 of 3.5 to 3.7 microns and SA of 3.0 to 3.5 $m^2/g$ (denoted as Powder I in Table 1)

TABLE 1

Selected Cr2O3 pigment powders

| $Cr_2O_3$ powder | D50, μm | D90, μm | Sa, m2/g | pH |
|---|---|---|---|---|
| Powder I | 2.5 | 3.7 | 3 | 7.5 |
| Powder II | 1.7 | 2.6 | 6 | 6.5 |

The corresponding slurries have been prepared employing these powders (five replicate slurry samples for each powder); these slurries are referred below as Slurry A (prior art slurry) and Slurry B (slurry of the present invention). It is important to note that the dispersing of Powder I in the Slurry A required a lengthy ball-milling stage, while Powder II produced a very good dispersion in Slurry B after less than 30 minutes of high shear mixing. Both slurries have been screened through 500 mesh screen prior to the coating application. This obviously simplifies and shortens a slurry production process and thus is an important practical advantage for a large-scale manufacturing.

Results of the particle sizing of the prepared Slurries A and B, after screening, are presented in Table 2; very good sample-to-sample repeatability for D50 (±0.3 μm) and D90 ((±0.5 μm) was observed. As seen from the data, employing $Cr_2O_3$ powder particles with lower median particle size D50 and oversized particle size D90 resulted in the $2^{nd}$ layer slurry also having a lower median particle size and lower D90 size of oversized particles.

TABLE 2

Slurries particle sizing and corresponding coatings roughness and gloss

| Slurry | D50, μm | D90, μm | Coated panels | Ra, μin | Gloss, % |
|---|---|---|---|---|---|
| A | 6.1 | 11.0 | Group A | 21 | 7 |
| B | 4.3 | 8.1 | Group B | 15 | 30 |

Table 2 also presents roughness and gloss of the parts coated with two-layer overlay system as follows. 2 inch×4 inch steel panels (1010 carbon steel, three replicate panels for each prepared slurry sample) were coated with the base layer (~25-30 μm thick), dried and cured at 350° C. for 0.5 hr and then air-spayed with the Slurries A (on Group A panels) or B (on Group B panels). The coated panels were then dried and cured at 350° C. for 0.5 hr to form the $2^{nd}$ layer of a two-layer overlay system. The thickness of the second layer was targeted at 5-7 μm.

As seen from these data, panels that were coated with the Slurry B were consistently smoother and glossier than the panels coated with Slurry A. Optical microscopy data (FIGS.

3A and 3B) also confirmed these results. The surface of the panels from Group A appeared rougher and also had a "gritty" appearance (i.e. showing some inclusions of isolated particles). SEM/EDS analysis data (FIGS. 4A and 4B) demonstrated that these inclusions are oversized particles of chromium oxide pigment "protruding" from the phosphate matrix formed by the binder. It was also found that these particle inclusions in the coating resulted from the presence of oversized $Cr_2O_3$ pigment particles in the slurry, whereas decrease in oversize particle size D90 of the slurry resulted in significant reduction in the amount of particle inclusions in the coating.

These oversized chromium oxide particles caused even stronger "grittiness" appearance in the three-layer overlay system that employs, on top of a $2^{nd}$ layer, an additional and optional layer of a seal coat; the seal coat layer comprising a chromate-phosphate binder substantially free of pigments. The sealer may be applied over the $2^{nd}$ layer coating to a minimum thickness of about 0.05 to 0.1 mils (about 1-2.5 μm).

On FIGS. 5A and 5B, are shown optical (20×) and SEM images (1000×) of a steel test panel with the prior art three-layer overlay system applied. Based on EDS analysis results of the highlighted particles, it appears to have a significantly higher Cr content and sharply decreased Mg and P content, compared to the overall surrounding matrix. Specifically, the highlighted particle shows, by weight percent, a Cr content of 54.8%; a Mg content of 2.7%; an O content of 35.8%; and a P content of 5.4% while the surrounding matrix showed a measured Cr content of 6.7%; a Mg content of 10.9%; an O content of 53.2%; and a P content of 28.0%.

Based on the images of FIGS. 5A and 5B together with the associated EDS analysis, it appears that any oversized particles of $Cr_2O_3$ present in the applied coating, cannot be covered completely with the seal coat layer of about 5 microns thickness. Comparison of Cr content on the oversized particles with the surrounding matrix indicates that these oversized particles are protruding from the surface and have significantly reduced coverage by the seal coat layer compared to other parts of the coating in the various matrix regions. Furthermore, the different reflectance of seal coat layer glassy matrix and protruding $Cr_2O_3$ particles makes these oversized particles visually distinct, and thus creates a more "gritty" appearance of the coating after application of the seal coat layer.

Depending on the size of $Cr_2O_3$ oversized particles, their coverage by the seal coat layer varies (e.g. higher degree of coverage for smaller $Cr_2O_3$ particles and lower degree of coverage for larger $Cr_2O_3$ particles). However, because of the protrusion of the particles from the surface, the seal coat layer on top of the particle always will be thinner than the rest of the matrix. Thus, reducing number and size of oversized $Cr_2O_3$ particles in the slurry has an overarching effect on the quality of the whole overlay system.

It was found that employing chromium oxide with particle size and PSD of the present invention allows significantly decreased defects and improved surface finish of the multilayer overlay system, i.e. reduced roughness and increased glossiness. FIGS. 6A and 6B show[s] Udimet 720 blade coated with three-layer overlay system of the present invention (Sample 21A: typical Ra=10-15 μin, typical % Gloss=75-80%)) having an improved surface finish compared to Udimet 720 blade coated with overlay system of the prior art (Sample 191: typical Ra=19-22 μin, typical % Gloss=40-50%).

The 2nd layer may also contain additional additives such as surfactants, corrosion inhibitors, viscosity modifiers, wetting agents and other conventional additives to increase oxidation and corrosion protection of the overlay system as well as to provide improved application and aesthetic properties. In addition to the chromium oxide pigment, other particulate metal oxide pigments may be included in the 2nd layer.

It was also observed that the slurry of the present invention (Slurry B in Table 2) consistently provides enhanced sprayability and more uniform coverage of the $2^{nd}$ layer over the base layer of the coating system as compared to the prior art slurry (Slurry A in Table 2). This is obviously an important practical advantage in a large-scale production process, especially when complex-shaped parts should be coated and when any edge non-uniformity and "picture framing" of the coating create potential of a service failure through coating cracking and peeling on the edges during curing and service life of a coated part. These visual observations have been confirmed by SEM comparative study of the coating thickness uniformity on two superalloy complex-shaped rectangular parts denoted as Part 4-196 and Part 21-197, where the 2nd layer was applied using Slurries A (prior art) and B (present invention), correspondingly.

According to the specifications of these components, total thickness of the applied coating system is tested in one location on one side of the rectangular part. Thus, to investigate the coating thickness uniformity over the part length from one end to the other, a vertical cross-section has been made right through this testing location; the samples were mounted in epoxy, polished and examined by SEM. Coating thickness measurements were taken on 1000× and 2000× magnifications in the locations shown in FIG. 7. FIGS. 8A and 8B show[s] an example of SEM micrographs with the coating system thickness measurements. Results for all areas measured by SEM are summarized by a graph shown on FIG. 9. As seen from these data, in the locations that are away from a part tip both parts have similar coating thicknesses in the range of 18-30 μm with the coating being the thickest in the area of a pedestal. However, there is a big difference in coating coverage uniformity in the tip area of the parts: Part 21-197 that employs Slurry B (of present invention) has a rather uniform coating layer on its tip, whereas the tip of part 4-196 derived from Slurry A (of prior art) has bare area with practically no coating on it, next to an area with a relatively thick coating (FIGS. 9, 10A, 10B and 10C).

The above-described multi-layer overlay system has been successfully used to provide high quality overlay which protect metal and metal alloy surfaces from oxidation and corrosion, particularly at high or moderately high temperatures. Most importantly, it was unexpectedly found that the present multilayer overlay system exhibits a dramatic improvement in thermal stability as compared to the prior art overlay. This improved thermal performance of the entire multilayer overlay system generally occurs where the 2nd layer of the multilayer overlay system is applied with a slurry employing chromium oxide pigment particles with median particle size D50 of between about 0.8 to 2.2 microns, preferably between 1.2 and 1.8 microns, oversized particles size D90 not exceeding about 3.0 microns, preferably not exceeding of about 2.0 to 2.8 micron, whereas SA of the particles is at least 4 $m^2/g$ and more preferably at least 6 $m^2/g$.

Figure 11A:
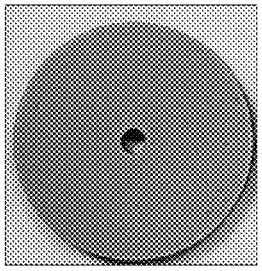
FIGS. 11A and 11B show[s] the Inconel 718 discs coated with the multilayer overlay system of the present invention exposed to a high thermal environment of about 1400° F. for 145 hours.
Figure 11B:
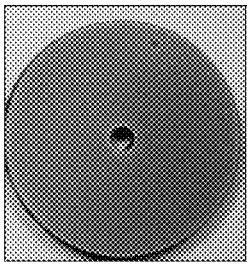

As shown in FIGS. 11A and 11B, Inconel 718 discs coated with the present multilayer overlay system with a total overlay system thickness in the range of about 1.2 to 1.4 mils and exposed to a high thermal environment of about 1400° F. for 145 hours preserved the overlay system without any visible signs of spallation. The shown Inconel 718 discs are in contrast to the Inconel 718 disc with the prior art multilayer overlay system applied and shown in FIG. 1 which exhibits significant spallation, thus highlighting the improved thermal performance of the multilayer overlay system of the present invention.

Figure 12A:
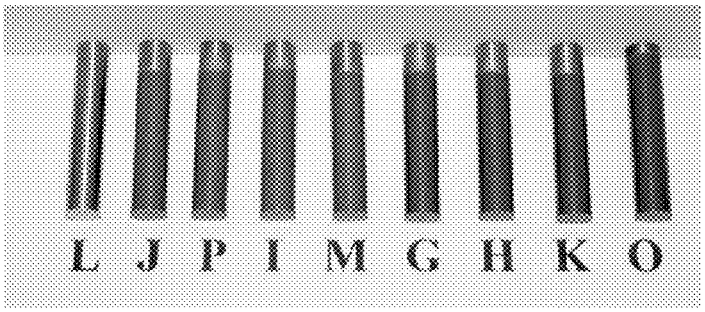
FIGS. 12A and 12B show before and after hot corrosion tests for various multilayer overlay systems.
Figure 12B:
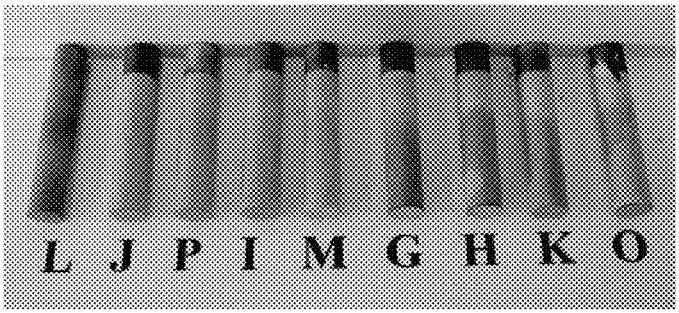

It was also unexpectedly found that the present multilayer overlay system exhibits a dramatic improvement of hot corrosion stability, as evidenced in a test conducted at about 1400° F. for 600 hours while exposed to corrosive environment of $CaSO_4$+carbon black mixture. As seen in FIGS. 12A and 12B, there is shown nine (9) sample Udimet 720 pins, with samples L representing a non-coated bare pin; samples J, P, I and M representing pins coated with the present multilayer overlay system that employs Slurry B of the present invention to produce the $2^{nd}$ layer in the three-layer system; and sample pins G, H, K and O coated with prior art multilayer overlay systems (Slurry A employed to produce the $2^{nd}$ layer). FIG. 12A shows the pins prior to the corrosion test whereas FIG. 12B shows images of the pins after exposure to a hot, corrosive environment containing $CaSO_4$+carbon black mixture at a temperature of about 1400° F. for 600 hours. Comparing the non-coated pin, to pins coated with the prior art slurry-based, multilayer overlay system and pins coated with the present slurry-based, multilayer overlay system highlights the improved thermal performance and corrosive performance of the present multilayer overlay system.

The slurry composition for the basecoat layer may be applied in a conventional way to the metal or metal alloy surface to be coated. Generally, it is desirable to degrease the part to be coated, blast with abrasive, and apply the layer by any suitable means, such as by spraying, brushing, dipping, dip spinning, etc., The coated substrate is then dried and subsequently cured at a temperature of about 340° C. to 350° C. for 15 to 30 minutes or longer. Curing may be performed at higher or lower temperatures if desired. The slurry is preferably applied in at least two coats or passes, each pass depositing a layer of about 0.1 mils to 0.25 mils in thickness, and more preferably a total of four coats or more to achieve a total thickness of the basecoat of between about 0.5 mils to about 3.0 mils. Drying of the basecoat is preferably performed at about 80° C. for 15 to 30 minutes. Curing of the basecoat preferably occurs at 345° C. (650° F.) for about 30 minutes. Higher humidity conditions of 50% humidity or more for application of the basecoat layer is also preferred.

The slurry composition for the 2nd layer may be applied to the basecoat layer by any suitable means, such as by spraying, brushing, dipping, dip spinning, etc. The intermediate layer is then dried and subsequently cured at a temperature of about 340° C. to 350° C. for 15 to 30 minutes or longer. The slurry is preferably applied in one to four coats or passes, each pass or coat depositing a layer of between about 0.1 mils to 0.25 mils in thickness to achieve a total thickness of the 2nd layer of between about 0.1 mils to about 1.0 mils. Drying of the 2nd layer is generally performed at about 80° C. (175° F.) for 15 to 30 minutes followed by curing of the 2nd layer at 345° C. (650° F.) for about 30 minutes.

Optionally, the seal coat slurry composition is then applied over the 2nd layer to a minimum thickness of about 0.05 to 0.1 mils. The seal coat slurry is preferably applied in two or more coats or layers, each coat between about 0.02 mils to 0.25 mils in thickness to achieve a minimum thickness of the seal coat of about 0.05 to 0.1 mils. Drying of the seal coat layer is generally performed at about 80° C. for 15 to 30 minutes followed by its curing at 345° C. (650° F.) for about 30 minutes.

From the foregoing, it should be appreciated that the present invention thus provides a slurry based multilayer overlay system comprising a basecoat layer formed from a slurry based ceramic pigment filled chromate-phosphate binder, a 2nd layer formed from a slurry based metal oxide pigment or ceramic oxide pigment filled chromate-phosphate binder, and, optionally, a sealcoat layer formed from a chromate-phosphate binder substantially free of pigments. Various modifications, changes, and variations of the present methods will be apparent to a person skilled in the art and it is to be understood that such modifications, changes, and variations are to be included within the purview of this application and the spirit and scope of the claims.

What is claimed is:

1. A multilayer overlay system for a metal substrate comprising:

a basecoat layer formed by applying a slurry comprising chromium oxide (Cr2O3) pigment particles dispersed in a phosphate-based binder, the basecoat layer having a thickness of between about 0.5 to 3.0 mils; and a second layer formed by applying a slurry comprising metal oxide pigment particles dispersed in a phosphate-based binder, wherein the metal oxide pigment particles comprises chromium oxide pigment particles having an enhanced dispersibility due to a narrow particle size distribution and optimized surface area, the second layer having a thickness of between about 0.1 to 1.0 mil, wherein the narrow particle size distribution is characterized in that the $50^{th}$ percentile of the particle size distribution has a diameter of between about 1.0 to about 2.0 microns;

wherein the $90^{th}$ percentile of the particle size distribution has a diameter of less than or equal to about 3.0 microns;

wherein the surface area of the metal oxide pigment particles in the second layer comprises chromium oxide pigment particles in a range between about 4 $m^2/g$ to about 6 $m^2/g$.

2. The multilayer overlay system of claim 1 further comprising a seal coat layer comprising a phosphate-based binder substantially free of pigments, the seal coat layer having a thickness greater than or equal to about 0.05 mils.

3. The multilayer overlay system of claim 2, wherein the seal coat layer has a thickness of about 0.1 mils or greater.

4. The multilayer overlay system of claim 1 wherein the surface roughness of each layer in the multilayer overlay system is less than or equal to about 30 μin.

5. The multilayer overlay system of claim 1, wherein the phosphate-based binder of the basecoat layer is chromate-phosphate.

6. The multilayer overlay system of claim 1, wherein the phosphate-based binder of the second layer is chromate-phosphate.

7. The multilayer overlay system of claim 1, wherein the phosphate-based binder of the seal coat layer is chromate-phosphate.

8. A severe environment multilayer overlay system for a metal substrate comprising:

a basecoat layer formed by applying a slurry comprising metal or metal oxide pigment particles dispersed in a phosphate-based binder, the basecoat layer having a thickness of between about 0.5 to 3.0 mils; and a second layer formed by applying a slurry comprising chromium oxide pigment particles dispersed in a phosphate-based binder, wherein the chromium oxide pigment particles have a narrow particle size distribution characterized in that the $50^{th}$ percentile of the particle size distribution has a diameter of between about 0.8 to about 2.2 microns and the $90^{th}$ percentile of the particle size distribution has a diameter of less than or equal to about 3.0 microns, and surface area of the particles is in a range between greater than or equal to about 4 $m^2/g$ to about 6 $m^2/g$, the second layer having a thickness of between about 0.1 to 1.0 mil;

wherein the surface roughness of the basecoat layer and the second layer in the overlay system is less than or equal to about 30 μin.

9. The severe environmental multilayer overlay system of claim 8, further comprising a seal coat layer comprising a phosphate-based binder substantially free of pigments, the seal coat layer having a thickness greater than or equal to about 0.05 mils.

10. The severe environmental multilayer overlay system of claim 9, wherein the seal coat layer has a thickness of greater than or equal to about 0.1 mils.

11. The severe environmental multilayer overlay system of claim 9, wherein the phosphate-based binder of the seal coat layer is chromate-phosphate.

12. The severe environmental multilayer overlay system of claim 8, wherein the phosphate-based binder of the basecoat is chromate-phosphate.

13. The severe environmental multilayer overlay system of claim 8, wherein the phosphate-based binder of the second layer is chromate-phosphate.

14. A method for applying a severe environment multilayer overlay system for a metal substrate comprising:

preparing surface of the metal substrate;

applying a slurry comprising metal or metal oxide pigment particles dispersed in a phosphate-based binder to the metal substrate to form a basecoat layer, the basecoat layer having a thickness of between about 0.5 to 3.0 mils;

curing the coated substrate with the basecoat layer;

preparing a slurry comprising chromium oxide pigment particles dispersed in phosphate-based binder, wherein the chromium oxide pigment particles have a narrow particle size distribution characterized in that the $50^{th}$ percentile of the particle size distribution has a diameter of between about 0.8 to about 2.2 microns and the $90^{th}$ percentile of the particle size distribution has a diameter of less than or equal to about 3.0 microns, and surface area of the chromium oxide pigment particles is greater than or equal to about 4 $m^2/g$ to about 6 $m^2/g$, applying said slurry to the basecoat to form a second layer, the second coating having a thickness of between about 0.1 to 1.0 mil wherein the surface roughness of the basecoat layer and the second layer in the overlay system is less than or equal to about 30 μin; and curing the coated substrate with the basecoat layer and the second layer.

15. The method of claim 14 wherein the surface roughness of the basecoat layer and the second layer is less than or equal to about 25 μin.

16. The method of claim 14, further comprising:

applying a slurry based phosphate-based binder substantially free of pigments to the second layer to form a seal coat layer, the seal coat layer having a thickness of greater than or equal to about 0.05 mils; and curing the coated substrate with the basecoat layer, the second layer and the seal coat layer.

17. The method of claim 16, wherein the phosphate-based binder of the seal coat layer is chromate-phosphate.

18. The method of claim 16 wherein the seal coat layer has a thickness of greater than or equal to about 0.1 mils.

19. The method of claim 14, wherein the phosphate-based binder of the basecoat is chromate-phosphate.

20. The method of claim 14, wherein the phosphate-based binder of the second layer is chromate-phosphate.

21. A multilayer overlay system for a metal substrate made from the process comprising the steps of:

applying a slurry comprising chromium oxide (Cr2O3) pigment particles dispersed in a phosphate-based binder to the metal substrate to form a basecoat layer, the basecoat layer having a thickness of between about 0.5 to 3.0 mils;

preparing a slurry comprising chromium oxide pigment filled phosphate-based binder wherein a particle size distribution of the chromium oxide pigment particles is characterized in that the $50^{th}$ percentile of the particle size distribution is a diameter of between about 1.0 to 2.0 microns and the $90^{th}$ percentile of the particle size distribution does not exceed a diameter of about 3.0 microns; and applying the slurry comprising chromium oxide pigment filled phosphate-based binder to the basecoat layer to form a second layer having a thickness of between about 0.1 to 1.0 mil, wherein the surface area of the chromium oxide pigment particles in the second layer is in a range between about 4 $m^2/g$ to about 6 $m^2/g$.

22. The multilayer overlay system for a metal substrate made from the process of claim 21, further comprising applying a slurry based phosphate-based binder substantially free of pigments to the second layer to form a seal coat layer, the seal coat layer having a thickness greater than or equal to about 0.5 mils.

23. The multilayer overlay system for a metal substrate made from the process of claim 22, wherein the phosphate-based binder of the seal coat layer is chromate-phosphate.

24. The multilayer overlay system for a metal substrate made from the process of claim 21, wherein the phosphate-based binder of the basecoat layer is chromate-phosphate.

25. The multilayer overlay system for a metal substrate made from the process of claim 21, wherein the phosphate-based binder of the second layer is chromate-phosphate.

* * * * *